US011629030B2

(12) United States Patent
Ishiguro

(10) Patent No.: US 11,629,030 B2
(45) Date of Patent: Apr. 18, 2023

(54) ELEVATOR CONTROL SYSTEM FOR LANDING CONTROL BASED ON CORRECTING GOVERNOR ROPE DISTANCE

(71) Applicant: MITSUBISHI ELECTRIC CORPORATION, Chiyoda-ku (JP)

(72) Inventor: Hidetaka Ishiguro, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 1229 days.

(21) Appl. No.: 15/781,208

(22) PCT Filed: Dec. 14, 2015

(86) PCT No.: PCT/JP2015/084894
§ 371 (c)(1),
(2) Date: Jun. 4, 2018

(87) PCT Pub. No.: WO2017/103968
PCT Pub. Date: Jun. 22, 2017

(65) Prior Publication Data

US 2018/0354745 A1 Dec. 13, 2018

(51) Int. Cl.
*B66B 1/28* (2006.01)
*B66B 1/34* (2006.01)
(Continued)

(52) U.S. Cl.
CPC ..... *B66B 1/40* (2013.01); *B66B 1/3492* (2013.01); *B66B 3/02* (2013.01)

(58) Field of Classification Search
CPC ..... B66B 1/40
See application file for complete search history.

(56) References Cited

U.S. PATENT DOCUMENTS 4,128,142 A * 12/1978 Satoh ..... B66B 1/285 187/293
4,485,895 A * 12/1984 Tachino ..... B66B 1/285 187/293
(Continued)

FOREIGN PATENT DOCUMENTS

JP 62-211277 A 9/1987
JP 9-12245 A 1/1997
(Continued)

OTHER PUBLICATIONS

International Search Report dated Mar. 1, 2016 in PCT/JP2015/084894, filed Dec. 14, 2015.
(Continued)

*Primary Examiner* — Christopher Uhlir
(74) *Attorney, Agent, or Firm* — Xsensus LLP

(57) ABSTRACT

An elevator control device, including an rpm detector, a landing-plate detector, and a controller, in which the controller includes a first remaining-distance calculating unit, which is configured to calculate a remaining distance to a destination floor as a first remaining distance based on the rpm, a second remaining-distance calculating unit, which is configured to calculate an ideal remaining distance from the detection of the landing plate to stop at a destination floor as a second remaining distance, an expansion-and-contraction amount estimating unit, which is configured to estimate an expansion amount of a governor rope from a difference value between the first remaining distance and the second remaining distance, and an expansion-and-contraction amount correcting unit, which is configured to correct the first remaining distance by adding a correction value calculated based on the estimated expansion amount.

21 Claims, 7 Drawing Sheets

(51) Int. Cl.

| | |
|---|---|
| ***B66B 5/00*** | (2006.01) |
| ***B66B 5/04*** | (2006.01) |
| ***B66B 5/12*** | (2006.01) |
| ***B66B 1/40*** | (2006.01) |
| ***B66B 3/02*** | (2006.01) |

(56) References Cited

U.S. PATENT DOCUMENTS

| | | | | |
|---|---|---|---|---|
| 7,014,014 | B2 * | 3/2006 | Mueller | B66B 5/06 187/293 |
| 8,763,763 | B2 * | 7/2014 | Kawakami | B66B 5/044 187/247 |
| 8,863,908 | B2 * | 10/2014 | Villa | B66B 1/302 187/295 |
| 9,567,188 | B2 * | 2/2017 | Huff | B66B 5/0025 |
| 10,399,820 | B2 * | 9/2019 | Roberts | B66B 5/0031 |
| 2012/0292136 | A1 * | 11/2012 | Washio | B66B 5/0031 187/393 |

FOREIGN PATENT DOCUMENTS

| | | | |
|---|---|---|---|
| JP | 2001-122538 | A | 5/2001 |
| JP | 2003-118946 | A | 4/2003 |
| JP | 2005-126185 | A | 5/2005 |
| JP | 2008-213967 | A | 9/2008 |
| WO | WO 2016/063379 | A1 | 4/2016 |
| WO | WO 2016/203650 | A1 | 12/2016 |

OTHER PUBLICATIONS

Office Action dated Nov. 19, 2020, in corresponding German patent Application No. 11 2015 007 184.9, 19 pages.

* cited by examiner

ELEVATOR CONTROL SYSTEM FOR LANDING CONTROL BASED ON CORRECTING GOVERNOR ROPE DISTANCE

TECHNICAL FIELD

The present invention relates to an elevator control device, which is configured to perform landing control by estimating an expansion and contraction amount of a governor rope when a car position is detected by using the governor rope.

BACKGROUND ART

There exists a related-art technology of detecting a car position by using a governor encoder (see, for example, Patent Literature 1). Further, there has been examined a technology of estimating an error of the governor encoder, which is generated by expansion and contraction of a governor rope, without additionally providing a new governor speed detector. As the technology described above, it is conceivable to estimate a governor encoder count error generated by the expansion and contraction of the governor rope from a deviation amount between a car movement amount calculated based on a count value of the governor encoder and an actually detected distance between landing plates when the car runs between the landing plates and to use a result of the estimation as a correction amount for landing so as to reduce a landing error.

CITATION LIST

Patent Literature

[PTL 1] JP 2008-213967 A

SUMMARY OF INVENTION

Technical Problem

However, the related-art technologies have the following problem.

In the technology of estimating the error of the governor encoder, which is generated by the expansion and contraction of the governor rope, special tuning work such as input of landing error measurement information actually measured by a maintenance person is required to achieve highly accurate landing control.

Further, in order to achieve ideal riding comfort with reduced vibrations, a transition of change in the expansion and contraction amount of the governor rope is required to coincide with a change in deceleration rate at the time of landing of an elevator. Even in this case, the special tuning work is needed.

The present invention has been made to solve the problem described above and has an object to provide an elevator control device, which is capable of carrying out a correction of a remaining distance in consideration of an expansion and contraction amount of a governor rope without prework such as special tuning or a learning operation.

Solution to Problem

According to one embodiment of the present invention, there is provided an elevator control device, including: a governor, which includes a governor rope and a governor sheave; an rpm detector, which is provided to the governor, and is configured to output an rpm according to rotation of the governor; a landing plate, which is provided according to each floor position in a building; a landing-plate detector, which is provided to a car of the elevator, and is configured to detect the landing plate provided according to the each floor position along with movement of the car; and a controller, which is configured to control a travel of the elevator based on the rpm output from the rpm detector and a result of the detection performed by the landing-plate detector, the controller including: a plate access detector, which is configured to detect a change of a state of the landing-plate detector from a state under which the landing plate is not detected to a state under which the landing plate is detected as an access state; a first remaining-distance calculating unit, which is configured to calculate a remaining distance to a destination floor as a first remaining distance based on the rpm output from the rpm detector; a second remaining-distance calculating unit, which is configured to calculate an ideal remaining distance from achievement of the access state to stop at the destination floor as a second remaining distance based on a result of detection performed by the plate access detector; an expansion-and-contraction amount estimating unit, which is configured to estimate an expansion amount of the governor rope from a difference value between the first remaining distance and the second remaining distance; and an expansion-and-contraction amount correcting unit, which is configured to calculate a correction value based on the expansion amount estimated by the expansion-and-contraction amount estimating unit, add the correction value to correct the first remaining distance, and output the corrected remaining distance.

Advantageous Effects of Invention

According to the present invention, the elevator control device has a configuration of estimating the expansion amount of the governor rope from the difference between the first remaining distance calculated according to the rpm of the governor and the second remaining distance corresponding to the preset ideal remaining distance to correct the remaining distance by using the obtained estimate amount. In this manner, during normal elevator service, the correction to the ideal remaining distance can be performed. Thus, special tuning or a learning operation for improving landing accuracy and reducing vibrations is not required to be performed by a maintenance person.

DESCRIPTION OF EMBODIMENTS

Figure 1:
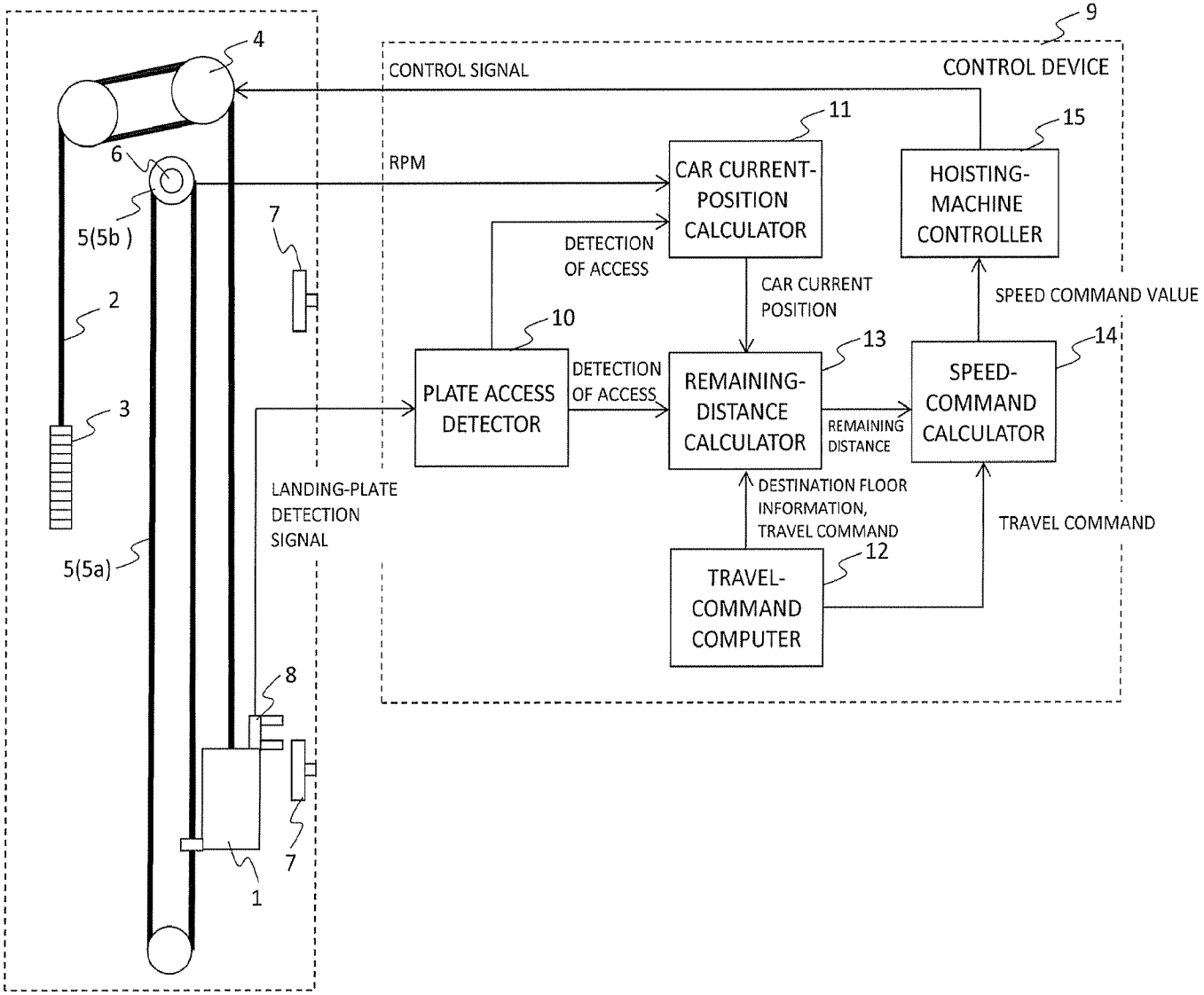
FIG. 1 is an overall schematic diagram of an elevator control device according to a first embodiment of the present invention.

Now, with reference to the drawings, an elevator control apparatus according to exemplary embodiments of the present invention is described. In the drawings, the same or corresponding components are denoted by the same reference symbols. A redundant description thereof is appropriately simplified or omitted.

First Embodiment

FIG. 1 is an overall schematic diagram for illustrating an elevator control apparatus according to a first embodiment of the present invention. An elevator according to the first embodiment includes a car 1 which a passenger rides and a counterweight 3 provided on a side opposite to the car 1 through a rope 2. The rope 2 is provided to pass over a hoisting machine 4. By hoisting up the rope 2 by the hoisting machine 4, the car 1 is raised and lowered inside a hoistway.

In an upper part of the hoistway, a governor 5 is installed. The governor 5 includes a rope 5*a* having end portions connected to the car 1 and a sheave 5*b* over which the rope is caused to pass. An rpm detector 6 configured to detect an rpm is provided to the governor 5. The rpm detector 6 outputs a signal corresponding to the rpm, for example, as a pulse output signal according to a rotation speed of the governor 5.

Inside the hoistway, landing plates 7 are provided at positions according to landing zones of floors, respectively. It is noted that A plurality of the landing plates 7 may be installed on each of the floors so as to correspond to a door zone being a door opening/closure allowable zone, a relevel zone in which releveling is allowed, and other zones.

A landing-plate detector 8 is installed to the car 1 as hardware means for detecting the landing plates 7. When the plurality of landing plates 7 are installed respectively for the door zone, the relevel zone, and other zones, a necessary number of the landing-plate detectors 8 corresponding thereto are similarly installed. The landing-plate detector 8 is located at the same height level as the landing plate 7 as a result of movement of the car 1 to detect the landing plate 7 and output a landing-plate detection signal.

Meanwhile, a control apparatus 9 illustrated in FIG. 1 according to the first embodiment includes a plate access detector 10, a car current-position calculator 11, a travel-command computer 12, a remaining-distance calculator 13, a speed-command calculator 14, and a hoisting-machine controller 15. It is noted that processing performed by each of the components included in the control apparatus 9 is not necessarily required to be performed by an individual device and the processing may be collectively performed by the same microcomputer.

The plate access detector 10 detects, based on the landing-plate detection signal output from the landing-plate detector 8, a change of a state of the landing-plate detector 8 from a state under which the landing plate 7 is not detected to a state under which the landing plate 7 is detected. Specifically, the plate access detector 10 detects whether or not the landing-plate detector 8 installed on the car 1 has accessed the landing plate 7.

The car current-position calculator 11 calculates a current position of the car 1 inside the hoistway based on the rpm output from the rpm detector 6 and a signal indicating the detection of access output from the plate access detector 10.

The travel-command computer 12 computes a travel command for the elevator and outputs the travel command and destination floor information.

The remaining-distance calculator 13 calculates and outputs a remaining distance to a destination floor based on the signal indicating the detection of access output from the plate access detector 10, the car current position output from the car current-position calculator 11, and the destination floor information and the travel command output from the travel-command computer 12.

The speed-command calculator 14 outputs a speed command value for moving the car 1 to the destination floor based on the travel command for the elevator output from the travel-command computer 12 and the remaining distance output from the remaining-distance calculator 13.

The hoisting-machine controller 15 controls the hoisting machine 4 based on the speed command value output from the speed-command calculator 14. Although not illustrated, the hoisting-machine controller 15 generally performs speed feedback control with feedback of the rpm of the hoisting machine 4, inverter PWM control with feedback of a current of the hoisting machine 4, or other control.

Figure 2:
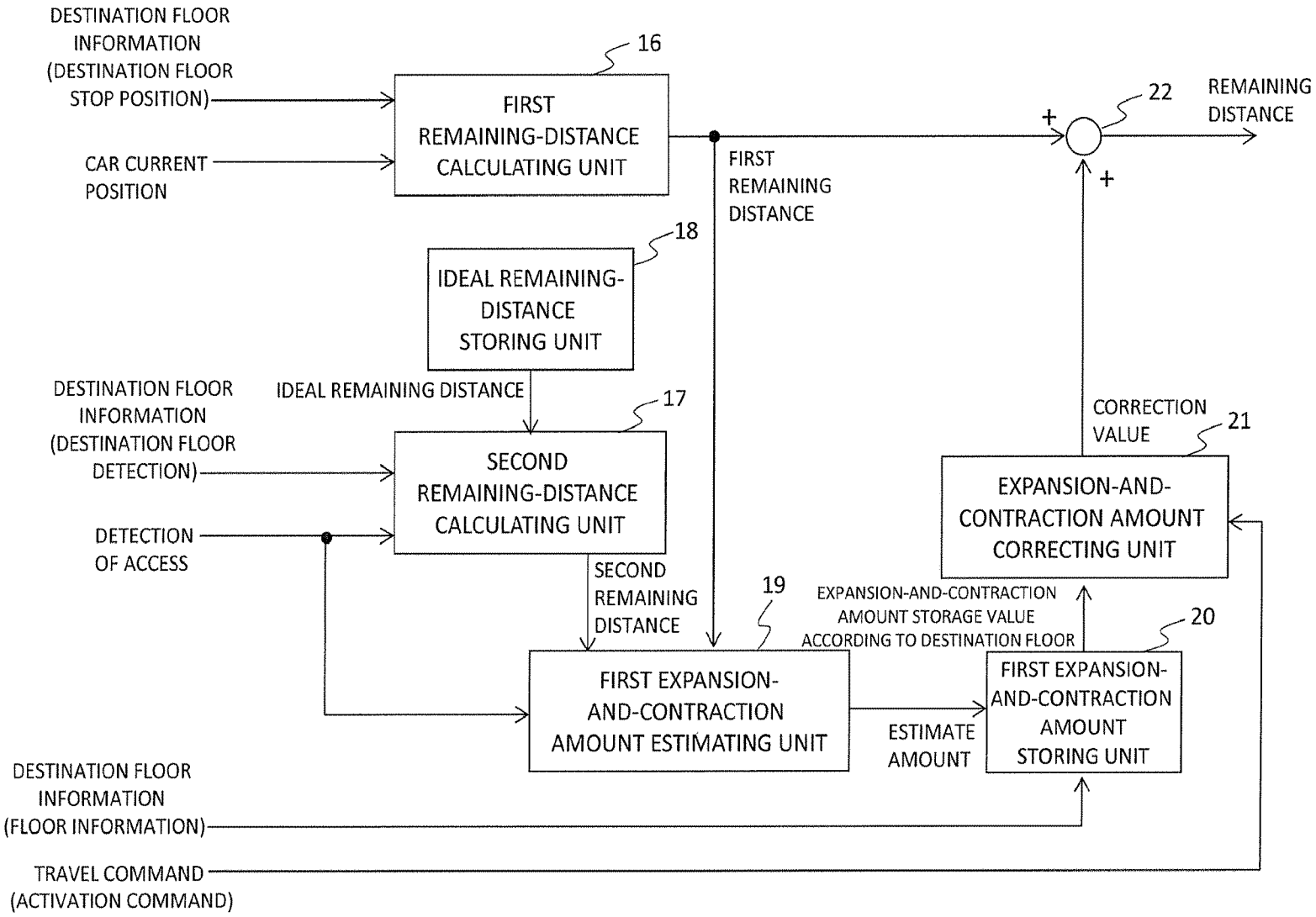
FIG. 2 is a diagram for illustrating an internal configuration of a remaining-distance calculator according to the first embodiment of the present invention.

FIG. 2 is a diagram for illustrating an internal configuration of the remaining-distance calculator 13 according to the first embodiment of the present invention. The remaining-distance calculator 13 includes a first remaining-distance calculating unit 16, a second remaining-distance calculating unit 17, an ideal remaining-distance storing unit 18, a first expansion-and-contraction amount estimating unit 19, a first expansion-and-contraction amount storing unit 20, an expansion-and-contraction amount correcting unit 21, and a first adder 22.

The first remaining-distance calculating unit 16 calculates a first remaining distance based on a difference between a destination-floor stop position contained in the destination floor information and the car current position. The car current position is output from the car current-position calculator 11 based on the rpm information output from the rpm detector 6. Specifically, the first remaining distance is a value obtained based on the rpm information output from the rpm detector 6.

The second remaining-distance calculating unit 17 calculates an ideal second remaining distance from the access to the stop at the destination floor based on a destination-floor detection signal contained in the destination floor information and information of the detection of access to the landing plate 7. In the ideal remaining-distance storing unit 18, an ideal remaining distance for landing the car 1 at an ideal deceleration/acceleration rate is stored in advance at each predetermined time interval.

Therefore, when the access to the landing plate 7 on the destination floor is detected, the second remaining-distance calculating unit 17 refers to the ideal remaining distance stored in the ideal remaining-distance storing unit 18 in accordance with elapsed time from the access and outputs the ideal remaining distance as the second remaining distance.

The first expansion-and-contraction amount estimating unit 19 estimates an expansion and contraction amount of the governor rope from a difference between the first remaining distance and the second remaining distance. Specifically, the first expansion-and-contraction amount estimating unit 19 outputs a value obtained by subtracting the first remaining distance from the second remaining distance as an estimate amount of the expansion and contraction amount of the governor rope.

The first expansion-and-contraction amount storing unit 20 samples the estimate amount output from the first expansion-and-contraction amount estimating unit 19 at predetermined time intervals to store the obtained values as expansion-and-contraction amount storage values. Further, the first expansion-and-contraction amount storing unit 20 stores the expansion-and-contraction amount storage values in association with floors based on floor information contained in the destination floor information output from the travel-command computer 12. Therefore, the first expansion-and-contraction amount storing unit 20 stores the expansion-and-extension amount storage value according to a position (height) of the car 1 from a bottom floor, for example, as an amount proportional to the height at which the car 1 is positioned from the bottom floor.

When running of the elevator is detected based on an elevator activation command included in the travel commands output from the travel-command computer 12, the expansion-and-contraction amount correcting unit 21 refers to the expansion-and-contraction amount storage value according to the destination floor, which is stored in the first expansion-and-contraction amount storing unit 20, in accordance with elapsed time from start of the running and elapsed time from the access and outputs the expansion-and-contraction amount storage value as a correction value.

For a value of the expansion-and-contraction amount storage value between the samplings, the expansion-and-contraction amount correcting unit 21 obtains and outputs the value by linear interpolation.

Further, the governor rope is expanded and contracted so as to be approximately proportional to the car deceleration rate during the deceleration. Therefore, ideally, it is desired to apply the correction value so as to be approximately proportional to the deceleration rate. For the prevention of complexity of the configuration and because no problem arises when importance is placed on accuracy of the remaining distance at a position close to a stop floor, the expansion-and-contraction amount correcting unit 21 uses the expansion-and-contraction amount storage value at the time of access to the landing plate 7 as the correction value before the access to the landing plate 7 on the destination floor to output the correction value.

The first adder 22 adds the first remaining distance output from the first remaining-distance calculating unit 16 and the correction value output from the expansion-and-contraction amount correcting unit 21 and outputs a value obtained by the addition as the remaining distance.

Figure 3:
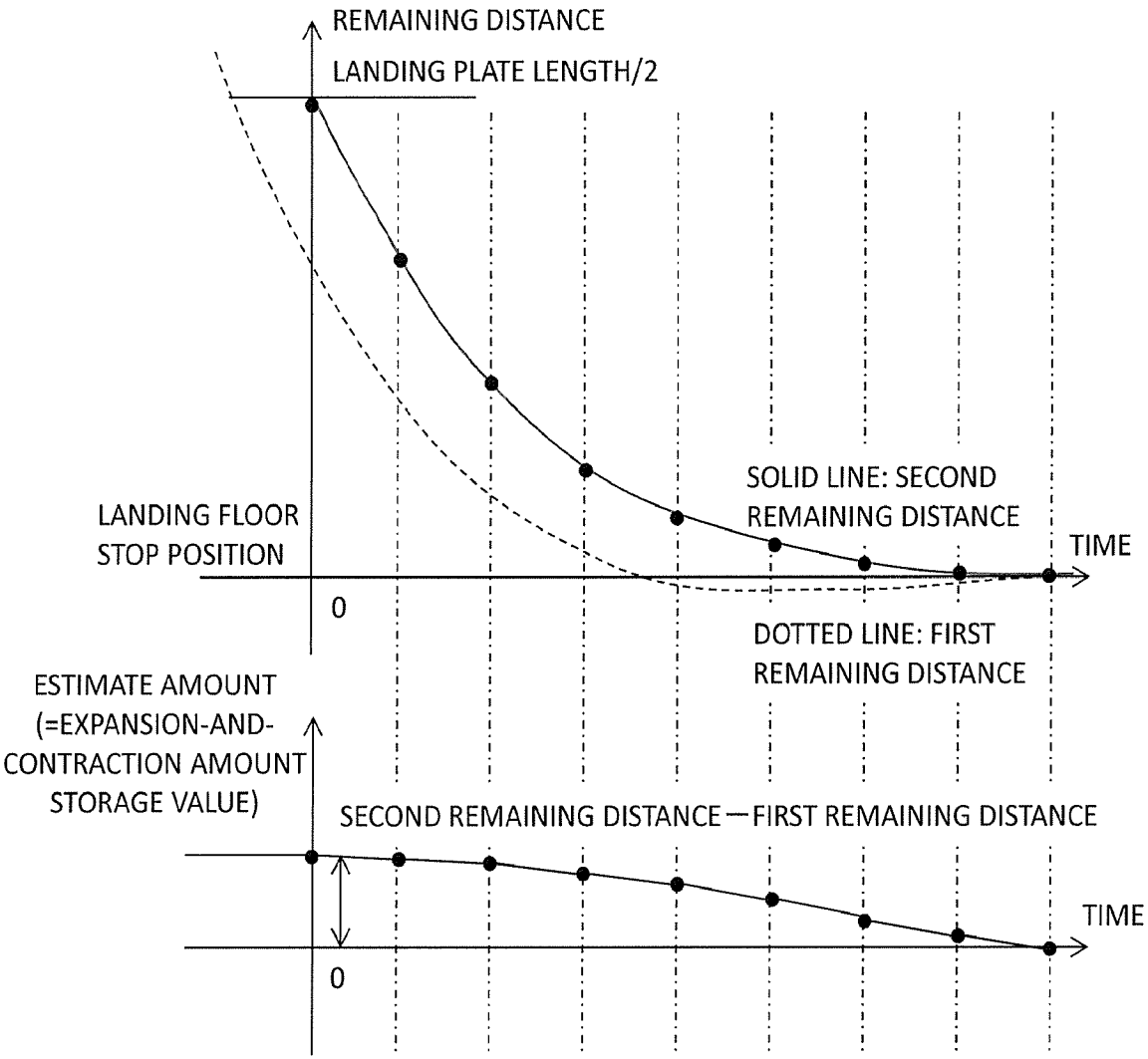
FIG. 3 is an explanatory graph relating to a method of estimating an expansion and contraction amount according to the first embodiment of the present invention.

FIG. 3 is an explanatory graph relating to a method of estimating the expansion and contraction amount according to the first embodiment of the present invention. In FIG. 3, the horizontal axis indicates time.

In an upper part of FIG. 3, a change in the remaining distance for the car 1 to a car floor stop position along with time is shown. The dotted line indicates the first remaining distance, whereas the solid line indicates the second remaining distance. Each of the points represented as the solid circles indicates the storage value of the ideal remaining distance stored in the ideal remaining distance storing unit 18 as data on which the second remaining distance is based.

Meanwhile, in a lower part of FIG. 3, the estimate amount obtained by the first expansion-and-contraction amount estimating unit 19 is shown. Each of the points represented as the solid circles indicates the expansion-and-contraction amount storage value stored in the first expansion-and-contraction amount storing unit 20.

When the landing plate 7 is detected at a time 0 in FIG. 3, the second remaining-distance calculating unit 17 outputs the second remaining distance which is the ideal remaining distance. The second remaining distance at the time 0 is equal to a length from a central position on the landing plate 7, which is the stop position for the car 1, to an end portion.

The first expansion-and-contraction amount storing unit 20 stores a difference value obtained by subtracting the first remaining distance from the second remaining distance at the time 0 as the estimate amount.

After the time 0, the car 1 runs toward the destination floor along with elapse of time. Therefore, the first remaining distance gradually decreases. The second remaining distance which is the ideal remaining distance similarly decreases along with the elapse of time.

Thus, the first expansion-and-contraction amount storing unit 20 stores the difference value between the second remaining distance and the first remaining distance as the estimate amount at each of times indicated by the solid circles shown in the upper part of FIG. 3, specifically, at each of the predetermined time intervals at which the second remaining distance is stored along with the elapse of time.

By the method described above, the first expansion-and-contraction amount storing unit 20 in the first embodiment can store or update the expansion-and-contraction amount storage value as the expansion and contraction amount of the governor rope according to the position of the car 1 inside the hoistway.

Effects obtained by the configuration described above are now summarized.

(Effect 1) The elevator control device according to the first embodiment has a configuration of estimating an expansion amount of the governor rope from the difference between the first remaining distance and the second remaining distance and correcting the remaining distance by using the obtained estimate amount. In this manner, during normal elevator service, the correction to the ideal remaining distance can be performed. As a result, special tuning or a learning operation performed by a maintenance person for improving landing accuracy and reducing vibrations is not needed.

(Effect 2) The elevator control device according to the first embodiment has a configuration of storing the ideal remaining distance for landing the car at the ideal acceleration/deceleration rate at the predetermined time intervals and calculating the remaining distance by performing the correction so as to achieve the ideal remaining distance. In this manner, the car 1 can be controlled at the ideal acceleration/deceleration rate to achieve ideal riding comfort.

(Effect 3) The elevator control device according to the first embodiment has a configuration of sampling the estimate value of the expansion amount of the governor rope at the predetermined time intervals to store the sampled values as the expansion-and-contraction amount storage values and obtaining the expansion and contraction amount of the governor rope between the samplings by the linear interpolation. In this manner, even when a storage capacity of a storage device which stores the expansion-and-contraction amount storage values is limited, the expansion and contraction amount of the governor rope can be smoothly calculated. Thus, the remaining distance can be prevented from becoming discontinuous.

(Effect 4) The elevator control device according to the first embodiment has a configuration of correcting the estimate amount (expansion and contraction amount) during the deceleration of the car at a constant rate by using the expansion-and-contraction amount storage value at the time of access to the landing plate before the access to the landing plate on the destination floor. In this manner, the remaining distance at the time of access to the landing plate on the destination floor can be caused to match with the ideal remaining distance to achieve ideal riding comfort.

Second Embodiment

An overall schema of an elevator control device according to a second embodiment is the same as that illustrated in FIG. 1 of the first embodiment described above. A remaining-distance calculator 13*a* in the second embodiment is partially different from that of the first embodiment described above in internal components and contents of signal processing. Therefore, differences are mainly described below.

Figure 4:
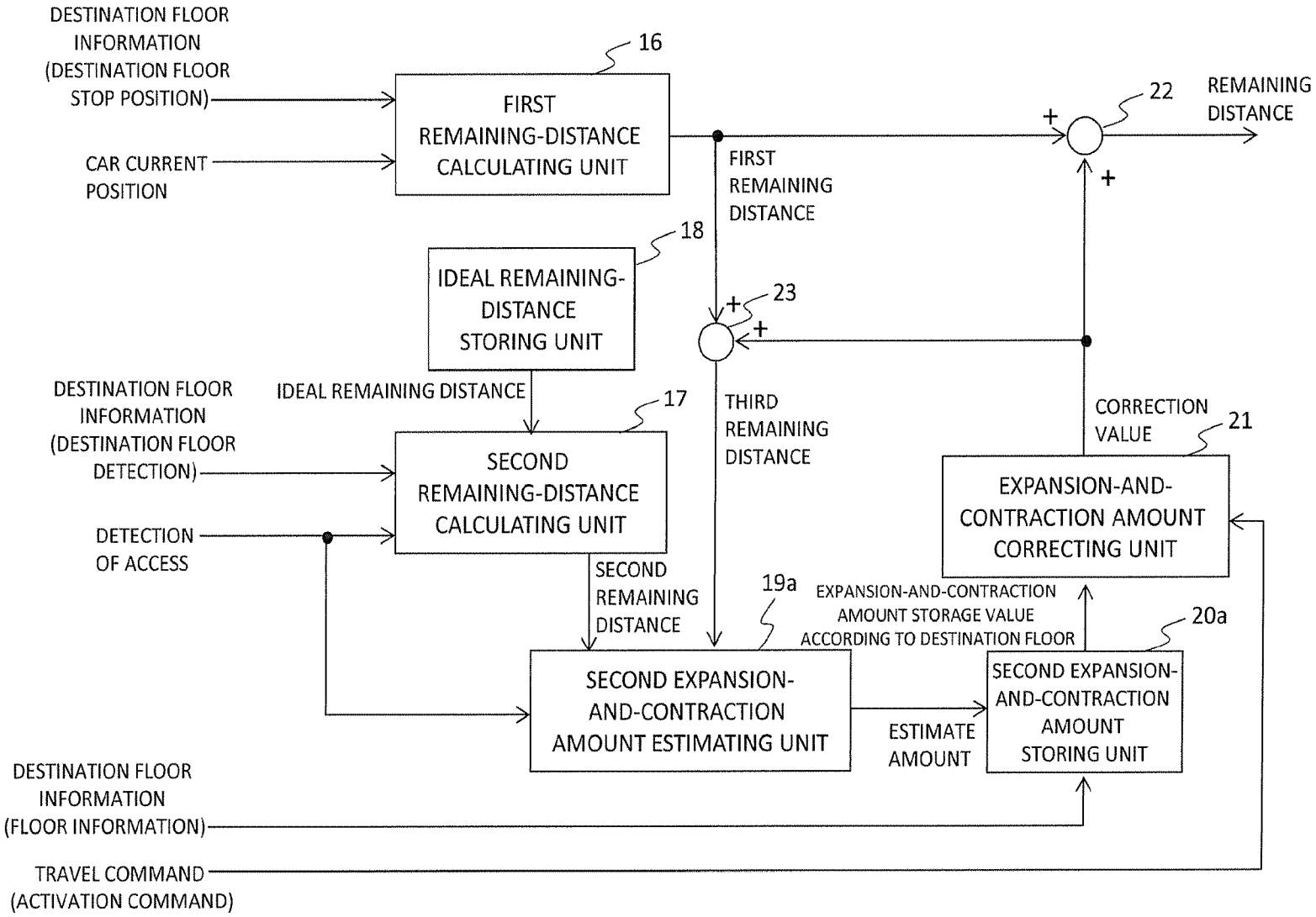
FIG. 4 is a diagram for illustrating an internal configuration of a remaining-distance calculator according to a second embodiment of the present invention.

FIG. 4 is a diagram for illustrating an internal configuration of the remaining-distance calculator 13*a* according to the second embodiment of the present invention. The remaining-distance calculator 13*a* includes a first remaining-distance calculating unit 16, a second remaining-distance calculating unit 17, an ideal remaining-distance storing unit 18, a second expansion-and-contraction amount estimating unit 19*a*, a second expansion-and-contraction amount storing unit 20*a*, an expansion-and-contraction amount correcting unit 21, a first adder 22, and a second adder 23.

The first remaining-distance calculating unit 16, the second remaining-distance calculating unit 17, the ideal remaining-distance storing unit 18, the expansion-and-contraction amount correcting unit 21, and the first adder 22 are the same as those in the first embodiment described above and are denoted by the same reference symbols.

The second adder 23 adds the first remaining distance and the correction value and outputs a result of addition as a third remaining distance. Specifically, the second adder 23 adds the expansion and contraction amount of the governor rope according to the destination floor to the first remaining distance and outputs the result of addition as the third remaining distance.

The second expansion-and-contraction amount estimating unit 19*a* of the second embodiment inputs the third remaining distance in place of the first remaining distance. Then, the second expansion-and-contraction amount estimating unit 19*a* outputs a value obtained by multiplying a difference value, which is obtained by subtracting the third remaining distance from the second remaining distance, by a predetermined coefficient as an estimate amount.

The second expansion-and-contraction amount storing unit 20*a* updates the expansion-and-contraction amount storage value by adding the estimate amount output from the second expansion-and-contraction amount estimating unit 19*a* to the previous expansion-and-contraction amount storage value and stores the updated expansion-and-contraction amount storage value. Specifically, in the second embodiment, the value obtained by multiplying the value which is obtained by subtracting the third remaining distance from the second remaining distance by the predetermined coefficient is added to the previous expansion-and-contraction amount storage value of the governor rope to be stored as a current expansion-and-contraction amount storage value.

Figure 5:
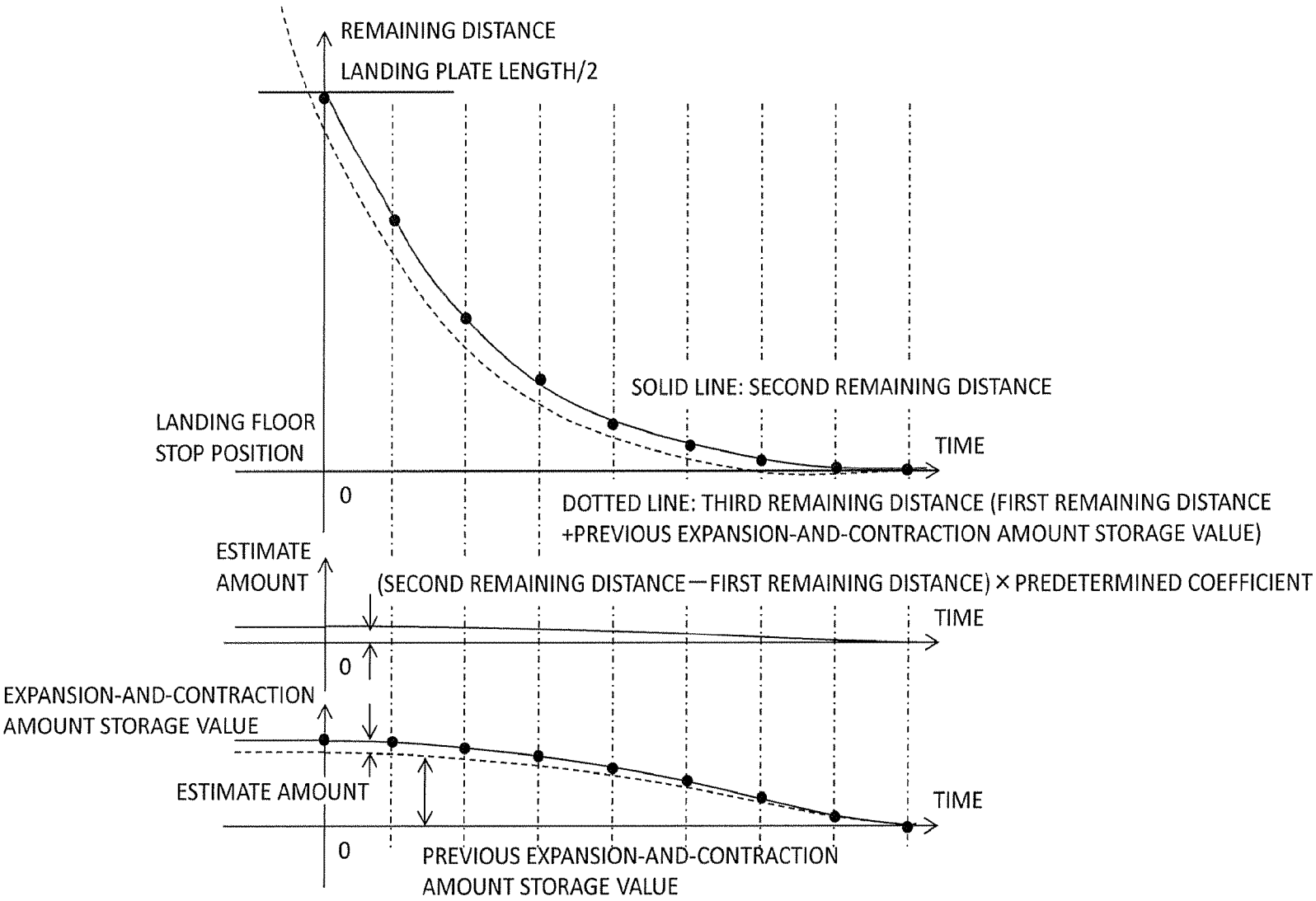
FIG. 5 is an explanatory graph relating to a method of estimating the expansion and contraction amount according to the second embodiment of the present invention.

FIG. 5 is an explanatory graph relating to a method of estimating the expansion and contraction amount according to the second embodiment of the present invention. In FIG. 5, the horizontal axis indicates time as in FIG. 3.

In an upper part of FIG. 5, a change in the remaining distance for the car 1 to a car floor stop position along with time is shown. The dotted line indicates the third remaining distance, whereas the solid line indicates the second remaining distance. As in FIG. 3, each of the points represented as the solid circles indicates the storage value of the ideal remaining distance stored in the ideal remaining distance storing unit 18. This second remaining distance is the same as the value shown in FIG. 3 referred to above.

Further, in the middle part of FIG. 5, the estimate amount obtained by the second expansion-and-contraction amount estimating unit 19*a* is shown. Further, in the lower part of FIG. 5, the current expansion-and-contraction amount storage value updated by adding the estimate amount obtained by the second expansion-and-contraction amount estimating unit 19*a* to the previous expansion-and-contraction amount storage value is shown. More specifically, the dotted line indicates the previous expansion-and-contraction amount storage value, whereas each of the solid circles indicates the current expansion-and-contraction amount storage value stored in the second expansion-and-contraction amount storing unit 20*a* after the update.

In FIG. 5, the third remaining distance calculated by the second adder 23 is obtained by adding the previous expansion-and-contraction amount storage value to the first remaining distance. Therefore, a difference between the second remaining distance and the third remaining distance decreases. Specifically, the third remaining distance is approximately close to the ideal remaining distance.

The second expansion-and-contraction amount estimating unit 19*a* outputs a value obtained by multiplying the value which is obtained by subtracting the third remaining distance from the second remaining distance by a predetermined coefficient as the estimate amount. The second expansion-and-contraction amount storing unit 20*a* stores the value obtained by adding the previous expansion-and-contraction amount storage value to the estimate amount as the latest expansion-and-contraction amount storage value at times indicated by the solid circles in FIG. 5, specifically, at predetermined time intervals at which the second remaining distance is stored.

By the method described above, the second expansion-and-contraction amount storing unit 20*a* of the second embodiment calculates the expansion-and-contraction amount storage value as the expansion and contraction amount of the governor rope in consideration of the previous correction amount. As a result, a learning effect can be obtained.

An effect obtained by the configuration described above is now summarized.

(Effect 1) The elevator control device according to the second embodiment has a configuration of obtaining the value calculated by adding the expansion-and-contraction amount storage value according to the destination floor to the first remaining distance as the third remaining distance and adding the value obtained by multiplying the value which is obtained by subtracting the third remaining distance from the second remaining distance by the predetermined coefficient to the previous expansion-and-contraction amount storage value to update the latest expansion-and-contraction amount storage value. In this manner, by suitably determining the predetermined coefficient, a learning speed for the expansion-and-contraction amount storage value can be controlled.

Third Embodiment

Figure 6:
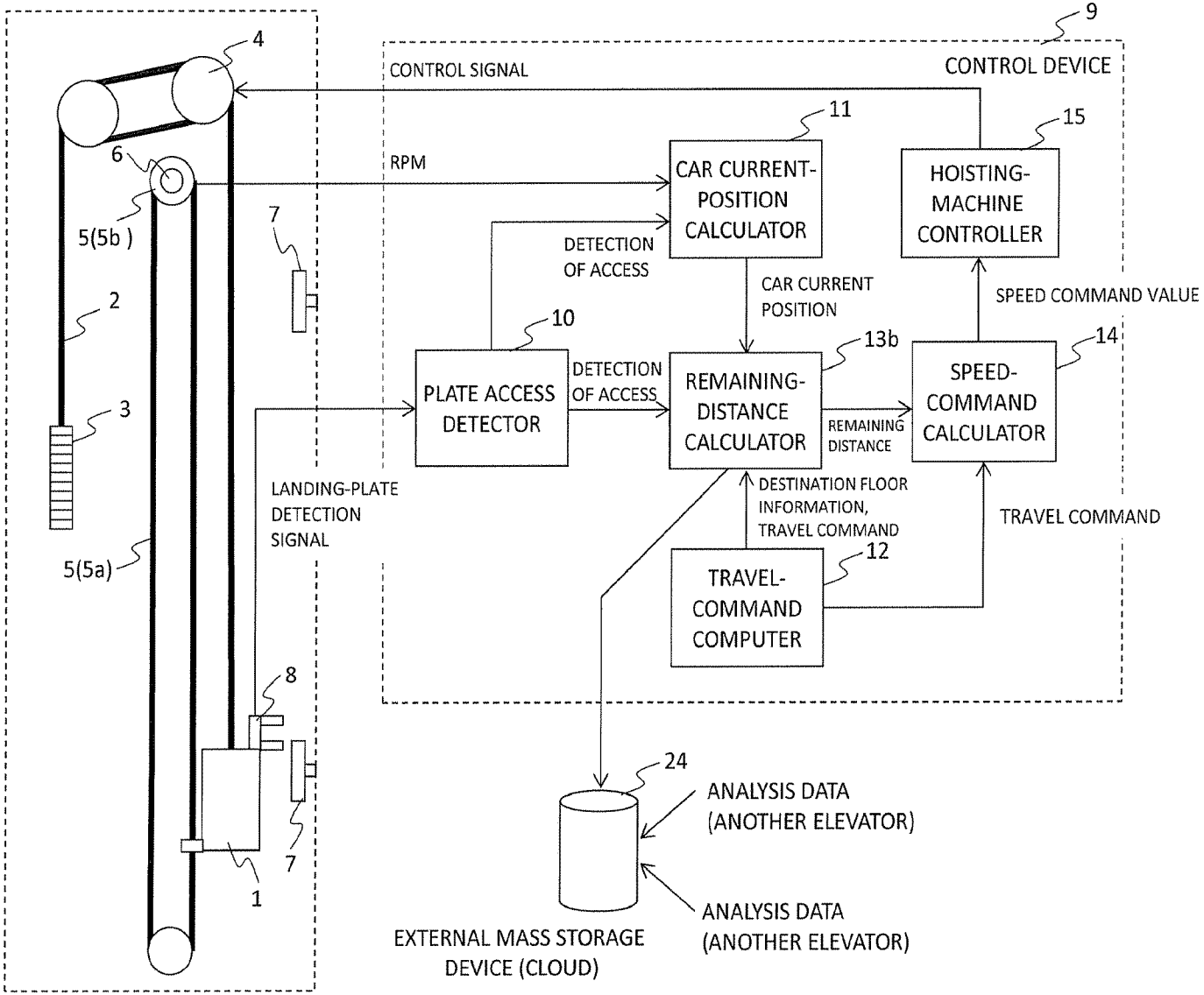
FIG. 6 is an overall schematic diagram of the elevator control device according to a third embodiment of the present invention.

FIG. 6 is an overall schematic diagram for illustrating an elevator control device according to a third embodiment of the present invention. Configurations of the elevator and the control apparatus 9 according to the third embodiment are the same as the configurations illustrated in FIG. 1 according to the first embodiment described above except for addition of an external mass storage device 24.

The external mass storage device 24 is provided outside of a building in which the elevator is installed by cloud computing using a network such as the Internet. Further, a remaining-distance calculator 13*b* of the third embodiment transmits the expansion-and-contraction amount storage value to the external mass storage device 24. As a result, the mass storage device 24 can accumulate data for each elevator.

Figure 7:
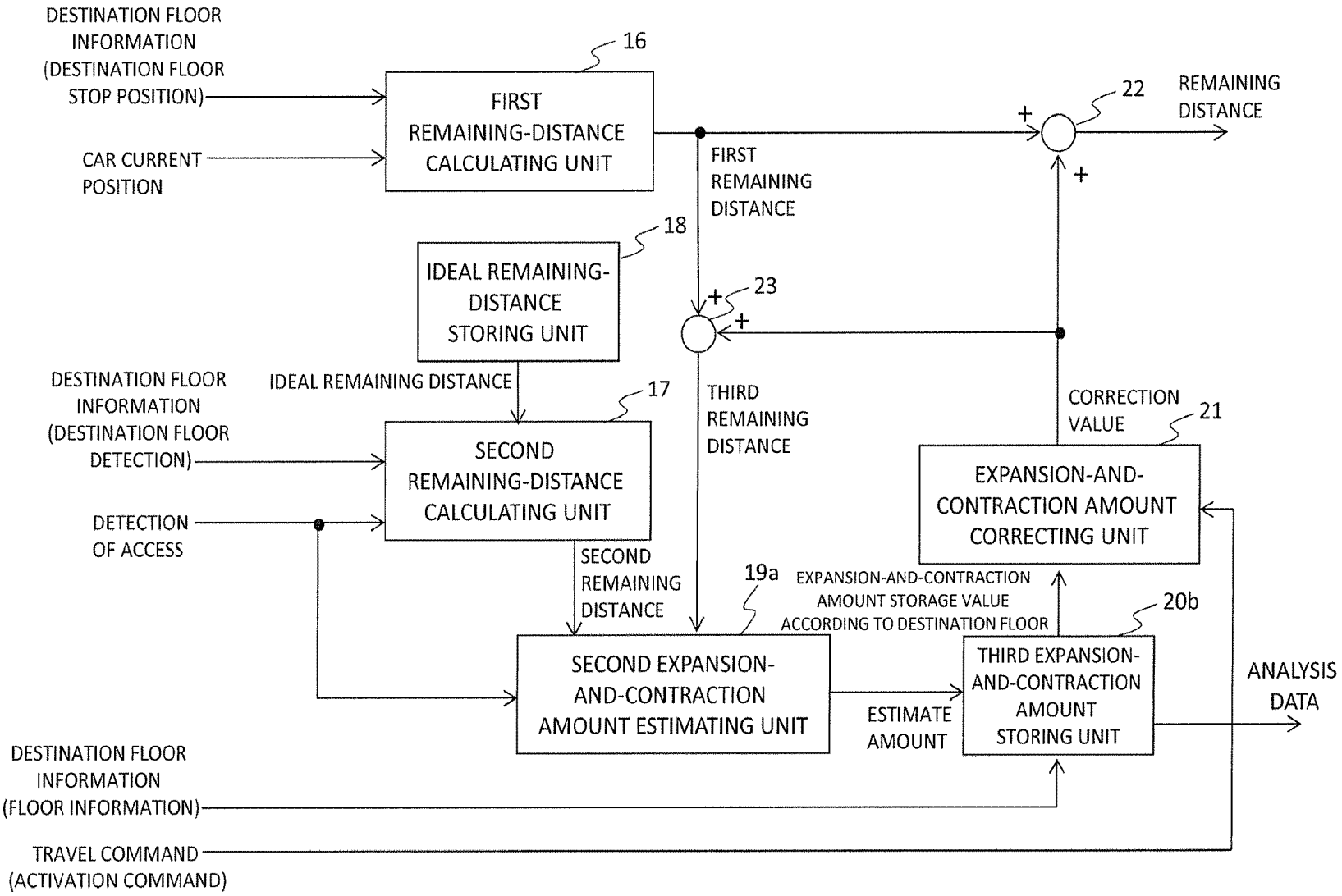
FIG. 7 is a diagram for illustrating an internal configuration of a remaining-distance calculator according to the third embodiment of the present invention.

FIG. 7 is a diagram for illustrating an internal configuration of the remaining-distance calculator 13*b* according to the third embodiment of the present invention. The remaining-distance calculator 13*b* includes a first remaining-distance calculating unit 16, a second remaining-distance calculating unit 17, an ideal remaining-distance storing unit 18, a second expansion-and-contraction amount estimating unit 19*a*, a third expansion-and-contraction amount storing unit 20*b*, an expansion-and-contraction amount correcting unit 21, a first adder 22, and a second adder 23.

A configuration illustrated in FIG. 7 is the same as the configuration illustrated in FIG. 4 of the second embodiment described above except that the second expansion-and-contraction amount storing unit 20*a* is replaced by a third expansion-and-contraction amount storing unit 20*b*. The third expansion-and-contraction amount storing unit 20*b* outputs the expansion-and-contraction amount storage value for each destination floor on a regular basis as analysis data to the external mass storage device 24.

An effect obtained by the configuration described above is now summarized.

(Effect 1) The elevator control device according to the third embodiment has a configuration of transmitting the expansion-and-contraction amount storage value to the external mass storage device to accumulate data for each elevator. In this manner, information can be collected for the expansion and contraction amount of the governor rope from elevators having different specifications. As a result, feedback to design by obtaining characteristics of the expansion and contraction amount of the rope and provision of maintenance information to the maintenance person are enabled through remote monitoring and analysis of collected data.

The invention claimed is:

1. An elevator control system for controlling an elevator, comprising:

a governor, which includes a governor rope and a governor sheave;

an rpm detector to output an rpm signal according to rotation of the governor;

a plurality of landing plates respectively associated with a plurality of floor positions in a building, including on a destination floor of the building;

a landing-plate detector on a car of the elevator, and to detect each of the plurality of landing plates along with movement of the car according to a speed command value for moving the car to the destination floor; and a controller to control a travel of the car of the elevator based on the rpm signal output from the rpm detector and a result of the detection performed by the landing-plate detector, the controller comprising:

a plate access detector to detect a change of a state of the landing-plate detector from a state under which none of the plurality of landing plates are detected to a state under which at least one of the plurality of landing plates is detected as an access state;

a first remaining-distance calculator to calculate a remaining distance to the destination floor as a first remaining distance based on the rpm signal output from the rpm detector;

a second remaining-distance calculator to calculate, in accordance with elapsed time from achievement of the access state, an ideal remaining distance for landing the car at an ideal deceleration/acceleration rate from achievement of the access state at the destination floor by detecting a landing plate, of the plurality of landing plates, at the destination floor to stop at the destination floor, as a second remaining distance based on a result of detection performed by the plate access detector;

an expansion-and-contraction amount estimator to estimate, in accordance with the elapsed time, an expansion or contraction amount of the governor rope from a difference value between the first remaining distance and the second remaining distance;

an expansion-and-contraction amount corrector to calculate, in accordance with the elapsed time, a correction value based on the estimated expansion or contraction amount estimated by the expansion-and-contraction amount estimator, add the correction value to correct, the first remaining distance, and output the corrected first remaining distance; and a speed-command calculator to output the speed command value for landing the car on the destination floor at the ideal declaration/acceleration rate based on the corrected first remaining distance output from the expansion-and-contraction amount corrector.

2. The elevator control system according to claim 1, wherein the second remaining-distance calculator:

includes an ideal remaining-distance storage memory to store in advance an ideal remaining distance for landing the car on the destination floor at the ideal acceleration/deceleration rate at a predetermined time interval; and refers to the ideal remaining distance stored in the ideal remaining-distance storage memory in accordance with the elapsed time from the achievement of the access state to output the second remaining distance.

3. The elevator control system according to claim 1, wherein the controller further comprises an expansion-and-contraction amount storage memory to sample the estimated expansion or contraction amount estimated by the expansion-and-contraction amount estimator at a preset time interval to store the sampled estimated expansion or contraction amount as an expansion-or-contraction amount storage value, and wherein the expansion-and-contraction amount corrector calculates a calculated expansion or contraction amount of the governor rope between the sampled estimated expansion or contraction amount by linear interpolation of the stored expansion-or-contraction amount storage value.

4. The elevator control system according to claim 2, wherein the controller further comprises an expansion-and-contraction amount storage memory to sample the estimated expansion or contraction amount estimated by the expansion-and-contraction amount estimator at a preset time interval to store the sampled estimated expansion or contraction amount as an expansion-or-contraction amount storage value, and wherein the expansion-and-contraction amount corrector calculates a calculated expansion or contraction amount of the governor rope between the sampled estimated expansion or contraction amount by linear interpolation of the stored expansion-or-contraction amount storage value.

5. The elevator control system according to claim 3, wherein the expansion-and-contraction amount corrector corrects the first remaining distance by using the expansion-or-contraction amount storage value obtained when the access state to the at least one landing plate is achieved before the access is made to the landing plate on the destination floor.

6. The elevator control system according to claim 4, wherein the expansion-and-contraction amount corrector corrects the first remaining distance by using the expansion-or-contraction amount storage value obtained when the access state to the at least one landing plate is achieved before the access is made to the landing plate on the destination floor.

7. The elevator control system according to claim 3, wherein the expansion-and-contraction amount storage memory stores the expansion-or-contraction amount storage value for each said floor position having the respectively associated landing plate, and wherein the expansion-and-contraction amount corrector reads the expansion-or-contraction amount storage value stored in the expansion-and-contraction amount storage memory according to a height at which the car is positioned from a bottom floor to correct the first remaining distance.

8. The elevator control system according to claim 4, wherein the expansion-and-contraction amount storage memory stores the expansion-or-contraction amount storage value for each said floor position having the respectively associated landing plate, and wherein the expansion-and-contraction amount corrector reads the expansion-or-contraction amount storage value stored in the expansion-and-contraction amount storage memory according to a height at which the car is positioned from a bottom floor to correct the first remaining distance.

9. The elevator control system according to claim 5, wherein the expansion-and-contraction amount storage memory stores the expansion-or-contraction amount storage value for each said floor position having the respectively associated landing plate, and wherein the expansion-and-contraction amount corrector reads the expansion-or-contraction amount storage value stored in the expansion-and-contraction amount storage memory according to a height at which the car is positioned from a bottom floor to correct the first remaining distance.

10. The elevator control system according to claim 6, wherein the expansion-and-contraction amount storage memory stores the expansion-or-contraction amount storage value for each said floor position having the respectively associated landing plate, and wherein the expansion-and-contraction amount corrector reads the expansion-or-contraction amount storage value stored in the expansion-and-contraction amount storage memory according to a height at which the car is positioned from a bottom floor to correct the first remaining distance.

11. The elevator control system according to claim 3, wherein the expansion-and-contraction amount estimator calculates a first value obtained by adding the correction value calculated by the expansion-and-contraction amount corrector and the first remaining distance as a third remaining distance and estimates a latest expansion or contraction amount by adding a second value obtained by multiplying a third value obtained by subtracting the third remaining distance from the second remaining distance by a preset coefficient to the previously estimated expansion or contraction amount of the governor rope.

12. The elevator control system according to claim 4, wherein the expansion-and-contraction amount estimator calculates a first value obtained by adding the correction value calculated by the expansion-and-contraction amount corrector and the first remaining distance as a third remaining distance and estimates a latest expansion or contraction amount by adding a second value obtained by multiplying a third value obtained by subtracting the third remaining distance from the second remaining distance by a preset coefficient to the previously estimated expansion or contraction amount of the governor rope.

13. The elevator control system according to claim 5, wherein the expansion-and-contraction amount estimator calculates a first value obtained by adding the correction value calculated by the expansion-and-contraction amount corrector and the first remaining distance as a third remaining distance and estimates a latest expansion or contraction amount by adding a second value obtained by multiplying a third value obtained by subtracting the third remaining distance from the second remaining distance by a preset coefficient to the previously estimated expansion or contraction amount of the governor rope.

14. The elevator control system according to claim 6, wherein the expansion-and-contraction amount estimator calculates a first value obtained by adding the correction value calculated by the expansion-and-contraction amount corrector and the first remaining distance as a third remaining distance and estimates a latest expansion or contraction amount by adding a second value obtained by multiplying a third value obtained by subtracting the third remaining distance from the second remaining distance by a preset coefficient to the previously estimated expansion or contraction amount of the governor rope.

15. The elevator control system according to claim 3, wherein the expansion-and-contraction amount storage memory has a function of transmitting the expansion-or-contraction amount storage value to an external mass storage device.

16. The elevator control system according to claim 4, wherein the expansion-and-contraction amount storage memory has a function of transmitting the expansion-or-contraction amount storage value to an external mass storage device.

17. The elevator control system according to claim 5, wherein the expansion-and-contraction amount storage memory has a function of transmitting the expansion-or-contraction amount storage value to an external mass storage device.

18. The elevator control system according to claim 6, wherein the expansion-and-contraction amount storage memory has a function of transmitting the expansion-or-contraction amount storage value to an external mass storage device.

19. The elevator control system according to claim 1, wherein the expansion or contraction amount estimated by the expansion-and-contraction amount estimator is corrected during deceleration of the car of the elevator at a constant rate prior to stopping at the destination floor.

20. The elevator control system according to claim 1, wherein of the plurality of landing plates, two or more landing plates are associated with one or more of the plurality of floor positions.

21. The elevator control system according to claim 1, wherein the correction value is fed back to the expansion-and-contraction amount estimator, and wherein the expansion-and-contraction amount estimator to calculate, in accordance with the elapsed time, a third remaining distance by adding the first remaining distance and the correction value, and to estimate, in accordance with the elapsed time, the expansion or contraction amount of the governor rope from a difference value between the third remaining distance and the second remaining distance.

* * * * *